US006684453B2

(12) United States Patent
Wang

(10) Patent No.: US 6,684,453 B2
(45) Date of Patent: Feb. 3, 2004

(54) HINGE ASSEMBLY CAPABLE OF DAMPING DOOR MOVEMENT

(75) Inventor: Yu-Jen Wang, Tainan Hsien (TW)

(73) Assignee: Fu Luong Hi-Tech Co., Ltd., Tainan Hsien (TW)

( * ) Notice: Subject to any disclaimer, the term of this patent is extended or adjusted under 35 U.S.C. 154(b) by 0 days.

(21) Appl. No.: 10/172,141

(22) Filed: Jun. 14, 2002

(65) Prior Publication Data

US 2003/0229965 A1 Dec. 18, 2003

(51) Int. Cl.[7] ..... E05F 3/20

(52) U.S. Cl. ..... 16/54; 16/50; 16/294; 16/49

(58) Field of Search ..... 16/54, 50, 56, 16/58, 57, 286, 287, 288, 294, 49, 68, 82, 84, DIG. 21

(56) References Cited

U.S. PATENT DOCUMENTS 4,075,735 A * 2/1978 Rock et al. ..... 16/278
4,102,004 A * 7/1978 Nagase ..... 16/49
4,251,900 A * 2/1981 Lautenschlager ..... 16/294
4,449,269 A * 5/1984 Sundermeier et al. ..... 16/50
4,669,147 A * 6/1987 Suchanek ..... 16/52
5,012,551 A * 5/1991 Beneke et al. ..... 16/49
5,016,317 A * 5/1991 Hung ..... 16/54
5,437,079 A * 8/1995 Park ..... 16/54
5,560,079 A * 10/1996 Jeynes ..... 16/80
5,657,511 A * 8/1997 Lan ..... 16/51

FOREIGN PATENT DOCUMENTS

FR 2476624 * 8/1981
JP 6-193335 * 7/1994

* cited by examiner

*Primary Examiner*—Chuck Y. Mah
(74) *Attorney, Agent, or Firm*—Ohlandt, Greeley, Ruggiero & Perle, L.L.P.

(57) ABSTRACT

A hinge assembly includes a damping unit mounted on a securing seat that is connected to a door frame, a housing embedded in a door panel, and a hinge member and a positioning member interconnecting the securing seat and the housing. The damping unit includes a fluid cylinder and a piston rod having an actuating end pivoted to the positioning member. Due to the presence of the damping unit, movement of the door panel relative to the door frame can be damped.

3 Claims, 6 Drawing Sheets

HINGE ASSEMBLY CAPABLE OF DAMPING DOOR MOVEMENT

BACKGROUND OF THE INVENTION

1. Field of the Invention

The invention relates to a hinge assembly, more particularly to a hinge assembly capable of damping door movement of a door panel or the like relative to a frame.

2. Description of the Related Art

Referring to FIGS. 1 to 3, a conventional hinge assembly 1 is shown to be mounted between a door frame 21 and a door panel 22 to permit pivotal movement of the door panel 22 between open and closed positions relative to the door frame 21. The hinge assembly 1 includes: a securing seat 11 mounted to an inner side of the door frame 21; a housing 12 mounted in a recess formed in an inner side of the door panel 22; a hinge member 13 having a first pivot end 131 mounted pivotally to the securing seat 11 via a first pivot pin 132, and a second pivot end 130 mounted pivotally to the housing 12 via a second pivot pin 133; a positioning member 14 having a first pivot end portion 141 mounted pivotally to the securing seat 11 via a third pivot pin 143 and disposed closer to the inner side of the door frame 21 than the first pivot pin 132, a second pivot end portion 140 mounted pivotally to the housing 12 via a fourth pivot pin 144, and a tab 142 projecting transversely from the first pivot end portion 141; and a spring 15 sleeved on the first pivot pin 132. The spring 15 has two distal ends abutting against an inner wall surface of the securing seat 11, and a protruding intermediate portion abutting against the tab 142. The second and fourth pivot pins 133, 144 are integrally formed as a U-shaped pin. The second pivot pin 133 is disposed closer to a closed inner end of the housing 12 than the fourth pivot pin 144. When the door panel 22 is in the closed position (FIG. 3), the fourth pivot pin 144 is located inwardly of an imaginary line (L) passing through the second and third pivot pins 133, 143 with respect to the first pivot pin 132, and the first pivot pin 132 is located within the housing 12.

When a force is exerted to push the door panel 22 from the closed position (FIG. 3) to the open position (FIG. 2), the hinge member 13 and the positioning member 14 turn pivotally and angularly about the respective pivot pins 132, 133, 143, 144 against the biasing action of the spring 15, with the tab 142 abutting against and depressing the intermediate portion of the spring 15. When the fourth pivot pin 144 is located between the first and second pivot pins 132, 133 and outwardly of the line (L), the door panel 22 is maintained in the open position against the biasing force of the spring 15, and a restoring force is stored in the spring 15. Thereafter, when a force is exerted to push the door panel 22 to move from the open position back to the closed position, the positioning member 14, as well as the hinge member 13, turns pivotally in a reverse direction. When the fourth pivot pin 144 is located inwardly of the line (L), the intermediate portion of the spring 15 is relieved of the pressure exerted by the tab 142 on the first pivot end portion 141 of the positioning member 14, and resumes its original position with a spring force that restores the positioning member 14, and hence the hinge member 13, to their original positions, thereby bringing the door panel 12 to the closed position.

The aforesaid conventional hinge assembly, however, suffers from the setback that the release of the restoring force in the spring 15 is abrupt so that the closing movement of the door panel 22 is likely to generate a banging sound, and may even hit the person using the door.

SUMMARY OF THE INVENTION

Therefore, the main object of the present invention is to provide a hinge assembly for interconnecting a door panel and a door frame, which can damp closing movement of the door panel relative to the door frame.

Accordingly, a hinge assembly of the present invention is adapted to interconnect a door frame and a door panel. The door panel has a proximate end disposed proximate to the door frame, and a recess formed in the proximate end. The hinge assembly includes:

a securing seat including a hollow seat body extending in a first direction, the seat body including vertically spaced-apart upper and lower side walls adapted to be connected to the door frame, an outer side wall interconnecting the upper and lower side walls and opposite to the door frame in a second direction that is transverse to the first direction, and a rear side wall, thereby confining a receiving space with an open front end and a closed rear end opposite to the open front end in the first direction;

a housing adapted to be disposed in the recess and having proximate and distal end walls opposite to each other in a third direction, and an open outer end and closed inner end opposite to each other in a fourth direction transverse to the third direction;

a hinge member having a first pivot end connected pivotally to the seat body at a first pivot point, and a second pivot end connected pivotally to the housing at a second pivot point;

a positioning member disposed between the seat body and the housing, the positioning member having a first pivot end portion pivoted to the seat body at a third pivot point, and a second pivot end portion pivoted to the housing at a fourth pivot point;

the first pivot point being disposed outwardly of the receiving space and proximate to the outer side wall of the seat body, the third pivot point being disposed in the receiving space and distal from the outer side wall of the seat body;

the second pivot end of the hinge memeber and the second pivot end portion of the positioning member extending into the housing via the open outer end, the second pivot point being disposed closer to the inner end of the housing than the fourth pivot point, the fourth pivot point being disposed closer to the proximate end wall of the housing than the second pivot point; and a damping unit including a fluid cylinder disposed in the receiving space and having one end connected to the seat body, and a piston rod extending through the other end of the fluid cylinder, the piston rod having an actuating end mounted on the first pivot end portion of the positioning member at a fifth pivot point offset from the third pivot point such that, when the door panel is rotated relative to the door frame from a closed position to an open position, the piston rod is retracted into the fluid cylinder to damp opening movement of the door panel, and such that, when the door panel is rotated from the open position to the closed position, the piston rod is extended from the fluid cylinder to damp closing movement of the door panel.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
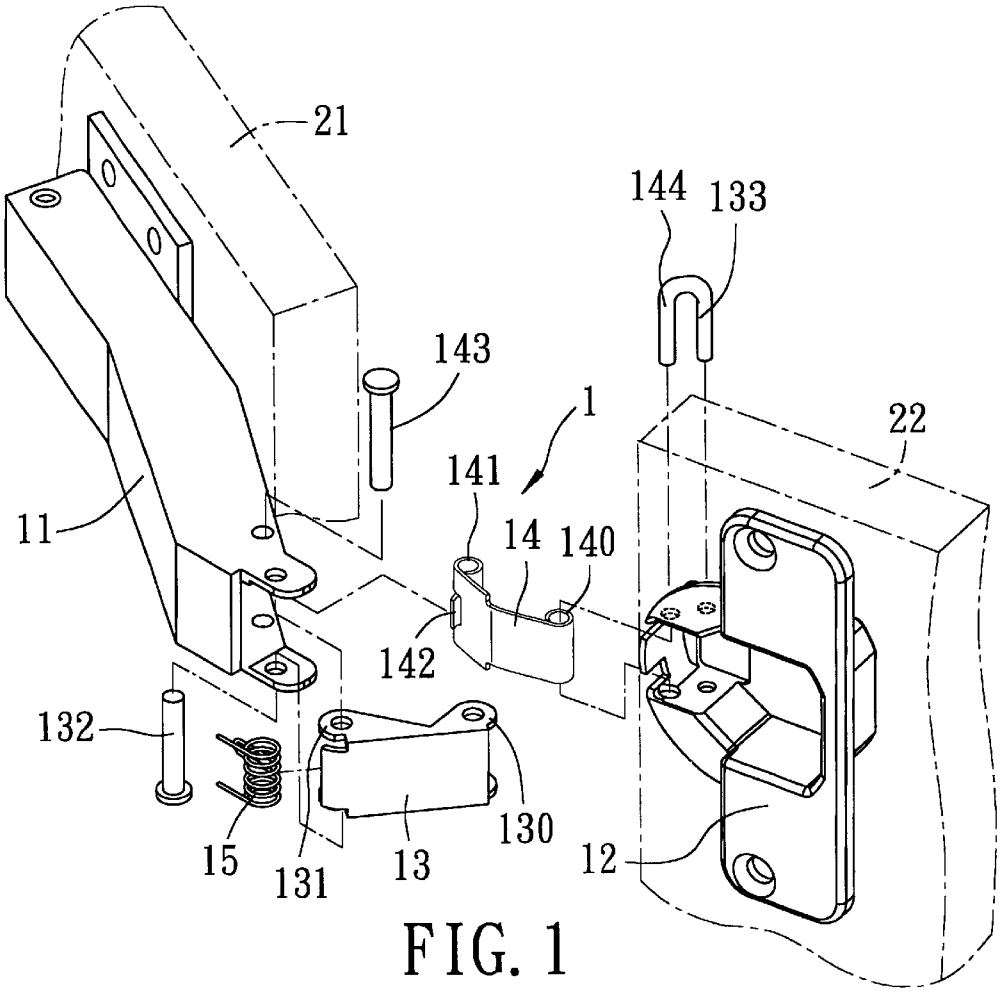
FIG. 1 PRIOR ART
FIG. 1 is an exploded perspective view of a conventional hinge assembly adapted to interconnect a door panel and a door frame.
Figure 2:
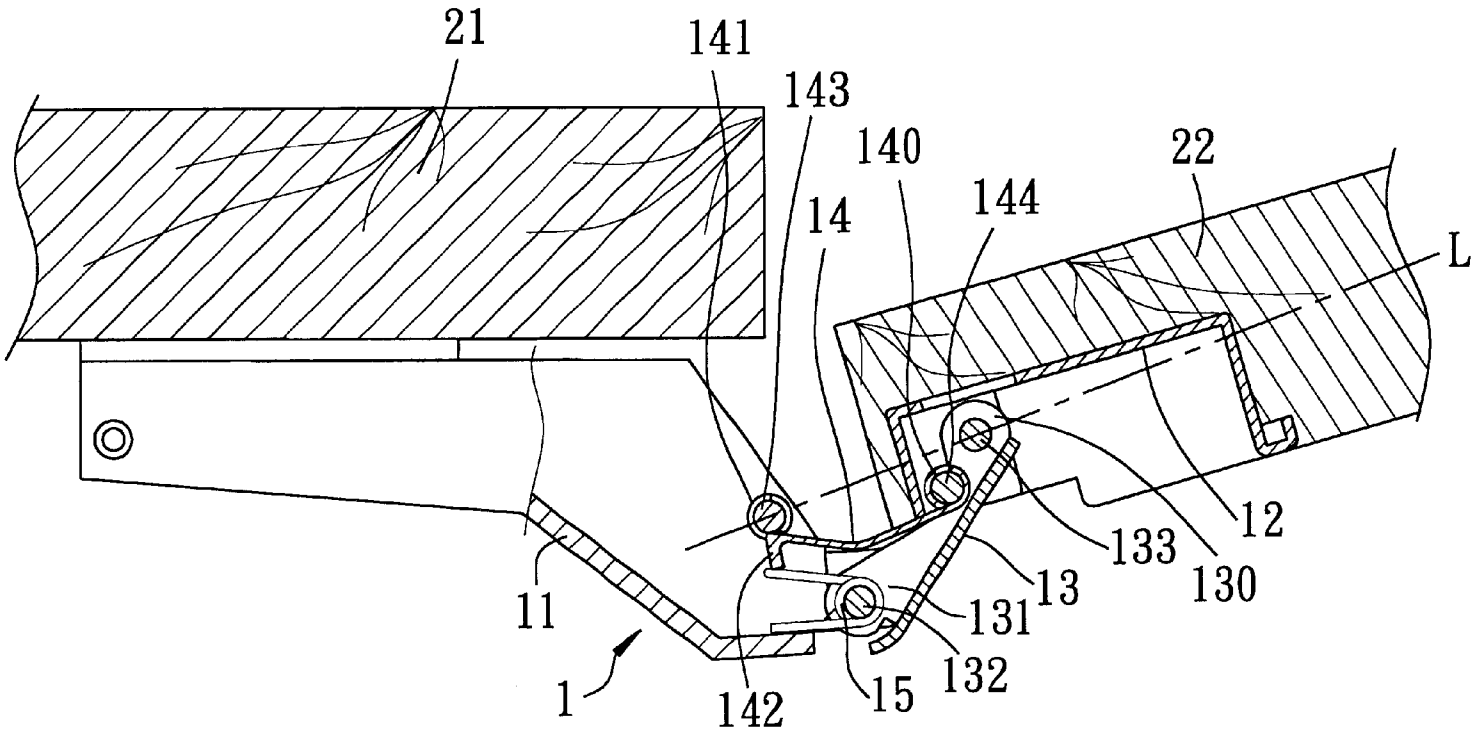
FIG. 2 PRIOR ART
FIG. 2 is a schematic sectional view of the conventional hinge assembly, illustrating the door panel in an open position.
Figure 3:
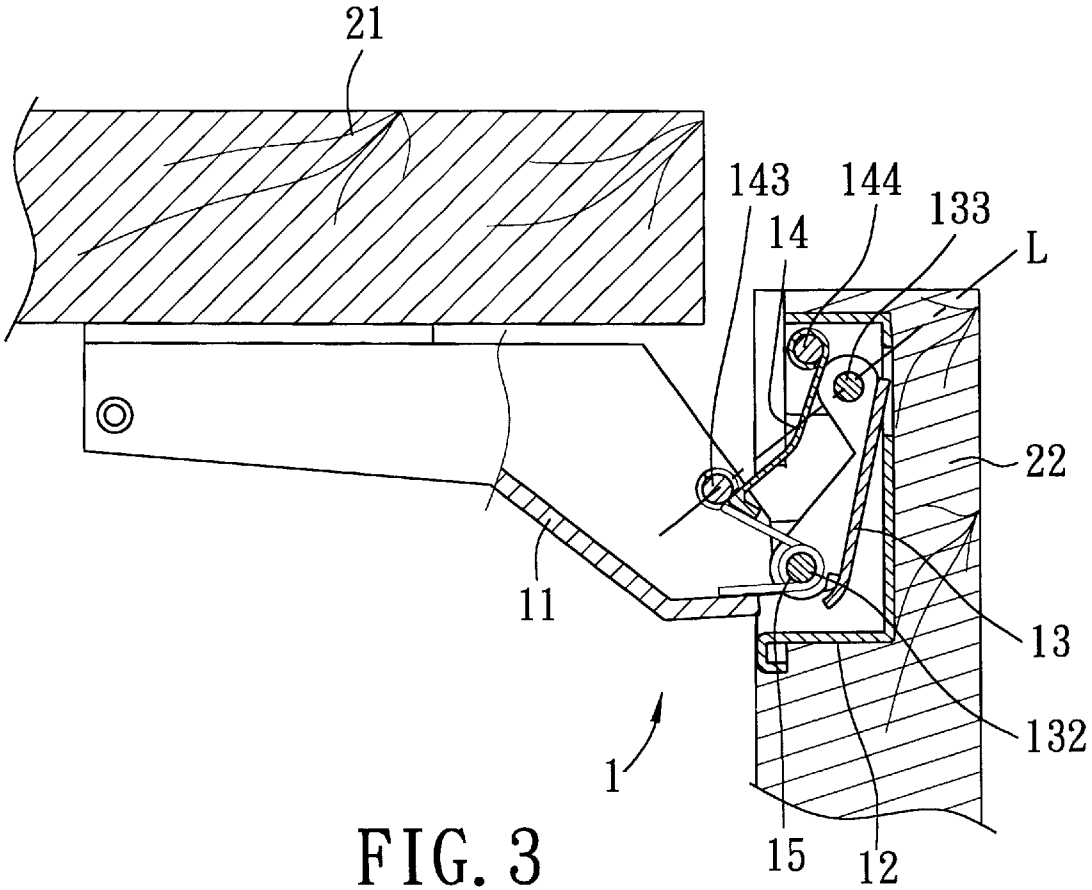
FIG. 3 PRIOR ART
FIG. 3 is a view similar to FIG. 2, illustrating the door panel in a closed position.
Figure 4:
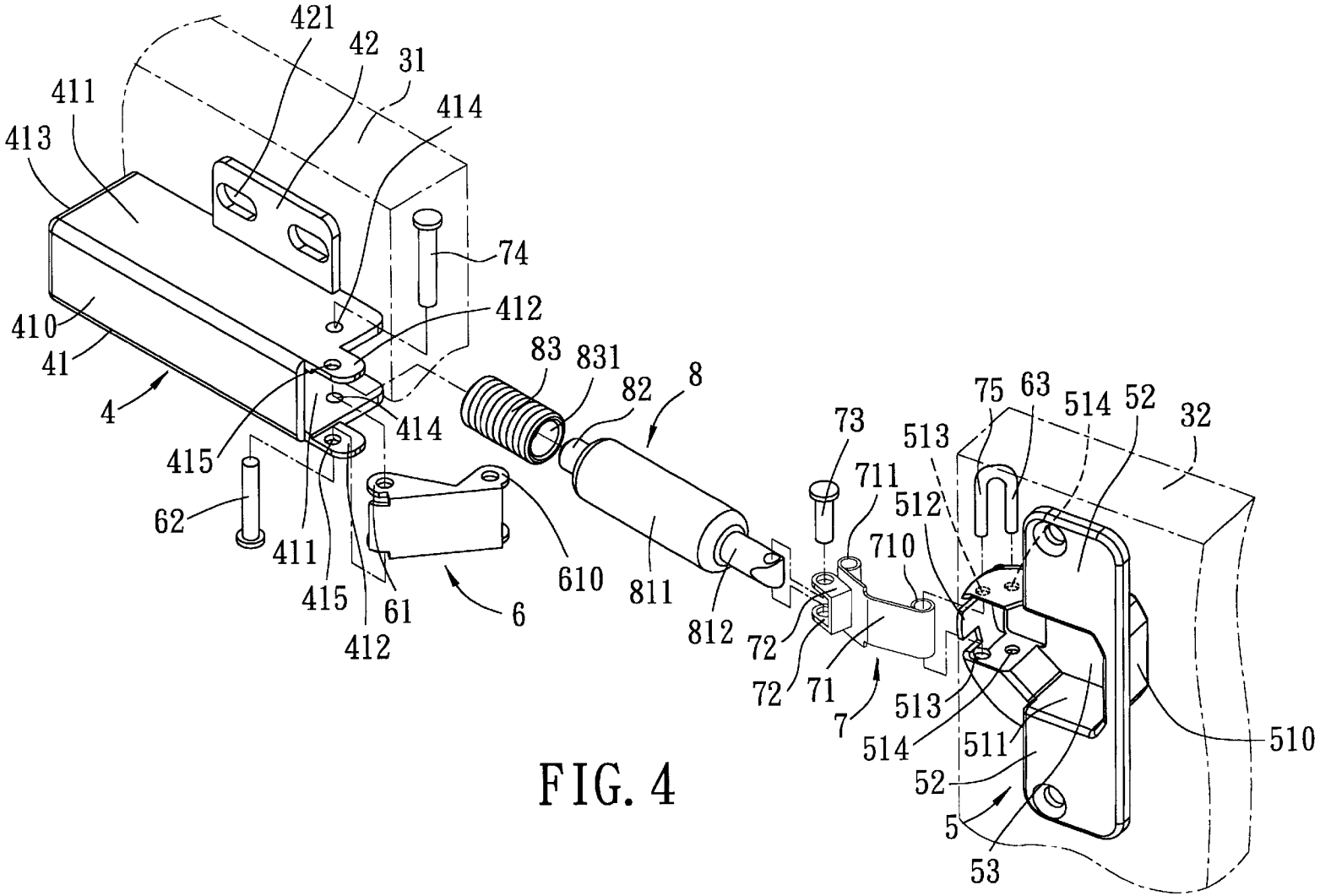
FIG. 4 is an exploded perspective view of a preferred embodiment of a hinge assembly according to the invention.
Figure 5:
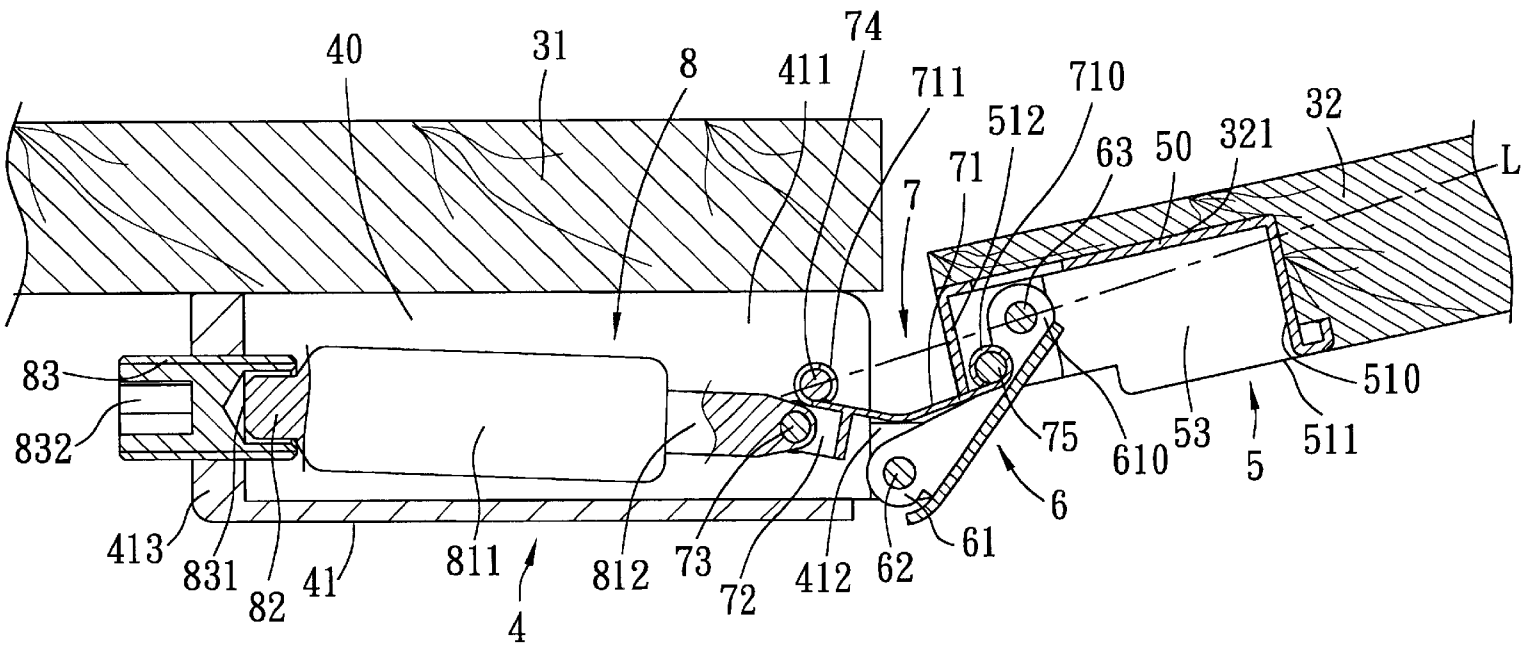
FIG. 5 is a schematic sectional view of the preferred embodiment in an open position.
Figure 6:
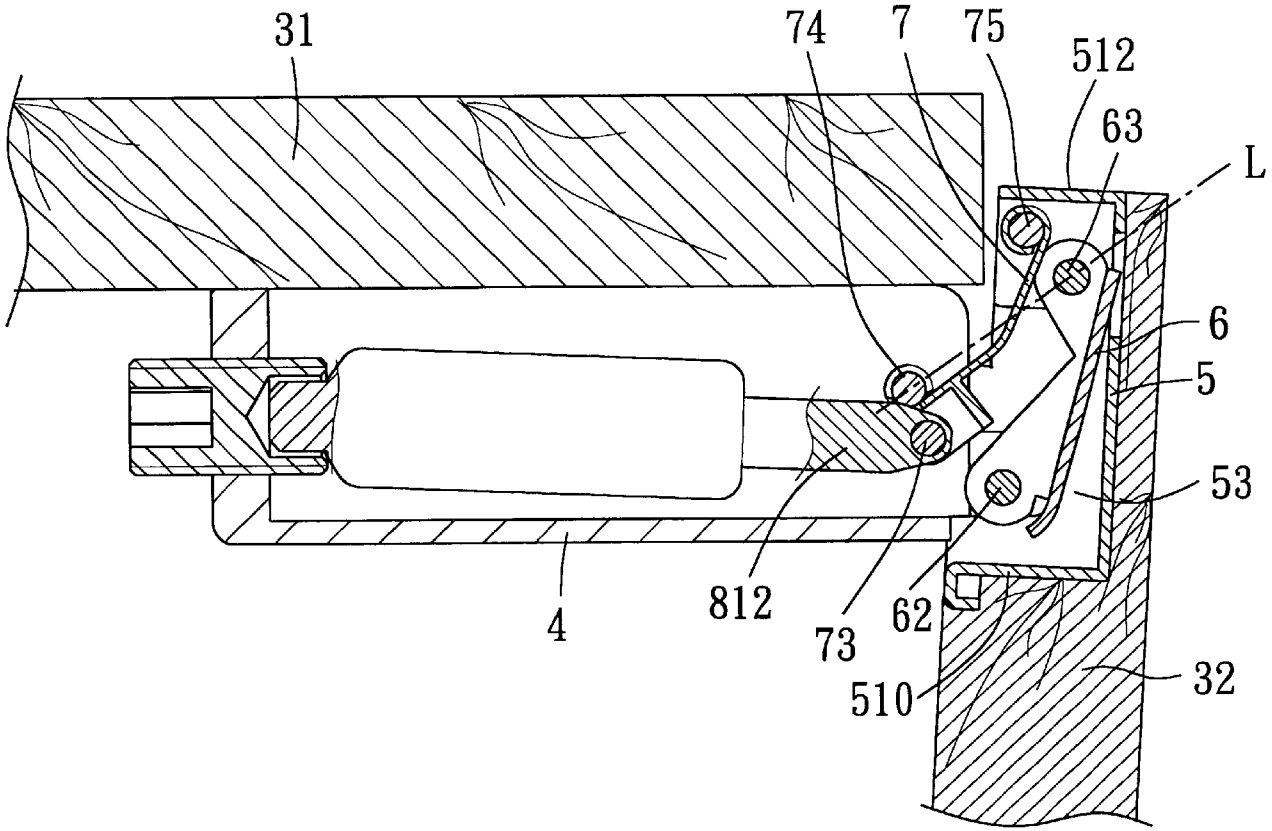
FIG. 6 is a view similar to FIG. 5, illustrating the door panel in a closed position.

Referring to FIGS. 4 to 6, the preferred embodiment of a hinge assembly according to the present invention is shown to be adapted to interconnect a door frame 31 and a door panel 32. The door frame 31 confines an opening. The door panel 32 is connected pivotally to a lateral side of the door frame 31 by the hinge assembly so as to be rotatable relative to the door frame 31 between an open position and a closed position for opening and closing the opening in the door frame 31. The door panel 32 has a proximate end proximate to the door frame 31, and a recess 321 formed in the proximate end. While the present invention is exemplified herein to interconnect a door frame and a door panel, it should be noted that the invention is not limited thereto and covers any closure member consisting of a frame and a panel, such as a window.

As shown, the hinge assembly includes a securing seat 4, a housing 5, a hinge member 6, a positioning member 7, and a damping unit 8. The securing seat 4 includes a hollow seat body 41 that extends in a first direction and that is connected to the door frame 31. The seat body 41 includes vertically spaced apart upper and lower side walls 411 connected to an inner side of the door frame 31, an outer side wall 410 interconnecting the upper and lower side walls 411 and disposed opposite to the door frame 31 in a second direction that is transverse to the first direction, and a rear side wall 413, thereby confining a receiving space 40 with an open front end and a closed rear end opposite to the open front end in the first direction. Two mounting plates 42 extend upwardly and downwardly from the upper and lower side walls 411, respectively, and are respectively provided with slots 421 adapted for extension of fastening members (not shown) therethrough so as to connect the seat body 41 to the inner side of the door frame 31. The upper and lower side walls 411 respectively have upper and lower pivot lugs 412 extending therefrom in the first direction and distal from the rear side wall 413. The upper and lower pivot lugs 412 are respectively provided with vertically aligned first pivot holes 415. The upper and lower side walls 411 are respectively provided with vertically aligned third pivot holes 414.

The housing 5 is embedded in the recess 321 in the door panel 32, and includes proximate and distal end walls 512, 510 that are opposite to each other in a third direction, a closed inner end 50, an open outer end opposite to the inner end 50 in a fourth direction transverse to the third direction, and vertically spaced-apart upper and lower end walls 511, thereby confining a housing space 53 thereamong. The upper and lower end walls 511 are provided with vertically aligned pairs of second and fourth pivot holes 514, 513. Two mounting plates 52 extend upwardly and downwardly from the upper and lower end walls 511, respectively, for fastening the housing 5 to the door panel 32.

The hinge member 6 has a first pivot end 61 connected pivotally to the seat body 41 by a first pivot pin 62 that extends through the first pivot holes 415 and that defines a first pivot point, and a second pivot end 610 opposite to the first pivot end 61, extending into the housing 5 via the open outer end, and connected pivotally to the housing 5 by a second pivot pin 63 that extends through the second pivot holes 514 and that defines a second pivot point.

The positioning member 7 is disposed between the seat body 41 and the housing 5, and includes an angled plate body 71 having a first pivot end portion 711 pivoted to the seat body 41 by a third pivot pin 74 that extends through the third pivot holes 414 and that defines a third pivot point, and a second pivot end portion 710 opposite to the first pivot end portion 711, extending into the housing 5 via the open outer end, and pivoted to the housing 5 by a fourth pivot pin 75 that extends through the fourth pivot holes 513 and that defines a fourth pivot point. In this embodiment, the second and fourth pivot pins 63, 75 are formed integrally as a generally U-shaped pin. The first pivot end portion 711 of the plate body 71 further has two vertically spaced-apart pivot lugs 72 extending transversely therefrom.

The first pivot pin 62 defining the first pivot point is disposed outwardly of the receiving space 40 and proximate to the outer side wall 410 of the seat body 41. The third pivot pin 74 defining the third pivot point is disposed in the receiving space 40 and distal from the outer side wall 410 of the seat body 41.

The second pivot pin 63 defining the second pivot point is disposed closer to the inner end 50 of the housing 5 than the fourth pivot pin 75 that defines the fourth pivot point, which is disposed closer to the proximate end wall 512 of the housing 5 than the second pivot pin 63. When the door panel 32 is in the closed position (FIG. 6), the first pivot pin 62 is located within the housing space 53 of the housing 5 and proximate to the distal end wall 510, and the fourth pivot pin 75 is located inwardly of an imaginary line passing through the second and third pivot pins 63, 74 with respect to the first pivot pin 62.

The damping unit 8 includes a fluid cylinder 811 and a piston rod 812. The fluid cylinder 811 is disposed in the receiving space 40, and has opposite front and rear ends in the first direction. The piston rod 812 extends through the front end of the fluid cylinder 811, and has an actuating end mounted on the first pivot end portion 711 of the plate body 71 by means of a fifth pivot pin 73 that extends through fifth pivot holes in the pivot lugs 72 and a through hole formed in the actuating end. The piston rod 812 is in an extended position when the door panel 32 is in the closed position (FIG. 6), and is in a retracted position when the door panel 32 is in the open position (FIG. 5). The fifth pivot pin 73 defines a fifth pivot point that is offset from the third pivot point defined by the third pivot pin 74. The seat body 41 has a threaded support 83 mounted threadedly and adjustably on the rear side wall 413. The threaded support 83 is in the form of an adjusting screw with a front end formed with an insert hole 831 for receiving and abutting against a rod 82 that extends rearwardly from the rear end of the fluid cylinder 811, and a rear end formed with a tool hole 832 of hexagonal cross section. The damping force of the fluid cylinder 811 can be adjusted by inserting a hexagonal head of a spanner into the tool hole 832 to drive the threaded support 83 to translate forwardly or rearwardly relative to the rear side wall 413 so that the extendible length of the piston rod 812 relative to the fluid cylinder 811 can be varied to thereby adjust the damping force of the fluid cylinder 811 in a known manner. It is noted that the rod 82 can be dispensed with so that the front end of the threaded support 83 abuts directly against the rear end of the fluid cylinder 811. Besides, as the construction and operation of the fluid cylinder 811 are known to those skilled in the art, and as the fluid cylinder 811 can be any commercially available hydraulic cylinder or pneumatic cylinder, the same will not be described in detail herein for the sake of brevity.

Referring to FIGS. 5 and 6, when a force is applied to rotate the door panel 32 from the closed position (FIG. 6), where the piston rod 812 is extended from the fluid cylinder 811, to the open position (FIG. 5), the hinge member 6 and the positioning member 7 are brought to turn pivotally and angularly about the first and second pivot pins 62, 63, and the third and fourth pivot pins 74, 75, so that the fourth pivot pin 75 is located between the first and second pivot pins 62, 63 and outwardly of the line (L). The piston rod 812 is pushed via the fifth pivot pin 73 to retract into the fluid cylinder 811, thereby damping opening movement of the door panel 32. At the same time, the part of the proximate end wall 512 of the housing 5 that is adjacent to the open outer end abuts against the positioning member 7 proximate to the second pivot end portion 710. As such, the door panel 32 is maintained at the open position. Thereafter, when a force is applied to rotate the door panel 32 from the open position to the closed position, the proximate end wall 512 of the housing 5 disengages from the positioning member 7. As the positioning member 7 and the hinge member 6 are restored to their original positions, the piston rod 812 is extended from the fluid cylinder 811, thereby damping closing movement of the door panel 32.

Due to the provision of the damping unit 8 which provides a damping force, abrupt movement of the door panel 32 relative to the door frame 31 can be avoided to prevent banging and enhance safety.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A hinge assembly adapted to interconnect a door frame and a door panel, the door panel having a proximate end disposed proximate to the door frame and a recess formed in the proximate end, said hinge assembly comprising:

a securing seat including a hollow seat body, said seat body including vertically spaced-apart upper and lower side walls adapted to be connected to the door frame, an outer side wall interconnecting the upper and lower side walls and opposite to the door frame, and a rear side wall connected to said upper and lower side walls and said outer side wall, thereby confining a receiving space with an open front end and a closed rear end opposite to said open front end;

a housing adapted to be disposed in the recess and having proximate and distal ends walls opposite to each other, and an open outer end and a closed inner end opposite to each other;

a hinge member having a first pivot end connected pivotally to said seat body at a first pivot point, and a second pivot end connected pivotally to said housing at a second pivot point;

a positioning member disposed between said seat body and said housing, said positioning member having a first pivot end portion pivoted to said seat body at a third pivot point, and a second pivot end portion pivoted to said housing at a fourth pivot point;

said first pivot point being disposed outwardly of said receiving space and proximate to said outer side wall of said seat body, said third pivot point being disposed in said receiving space and distal from said outer side wall of said seat body;

said second pivot end of said hinge member and said second pivot end portion of said positioning member extending into said housing, said second pivot point being disposed closer to said inner end of said housing than said fourth pivot point, said fourth pivot point being disposed closer to said proximate end wall of said housing than said second pivot point; and a damping unit including a fluid cylinder disposed in said receiving space and having one end connected to said seat body, and a piston rod extending through the other end of said fluid cylinder, said piston rod having an actuating end mounted on said first pivot end portion of said positioning member at a fifth pivot point offset from said third pivot point such that, when the door panel is rotated relative to the door frame from a closed position to an open position, said piston rod is retracted into said fluid cylinder to damp opening movement of the door panel, and such that, when the door panel is rotated from the open position to the closed position, said piston rod is extended from said fluid cylinder to damp closing movement of the door panel.

2. The hinge assembly as claimed in claim 1, wherein said seat body has a threaded support mounted threadedly and adjustably on said rear side wall for connecting with said one end of said fluid cylinder.

3. A hinge assembly comprising:

a securing seat including an elongate hollow seat body that extends in a longitudinal direction, said seat body including vertically spaced-apart upper and lower side walls, an outer side wall interconnecting said upper and lower side walls, and a rear side wall connected to said outer side wall, thereby configuring said seat body with a receiving space that has an open front end and a closed rear end opposite to said open front end in the longitudinal direction, said rear side wall having a threaded support that is mounted threadedly and adjustably thereon and that extends in the longitudinal direction, said threaded support having an end portion extending into said receiving space and formed with a blind insert hole;

a housing;

a hinge member having a first pivot end connected pivotally to said seat body outwardly of said open front end, and a second pivot end connected pivotally to said housing;

a positioning member disposed between said seat body and said housing, said positioning member having a first pivot end portion connected pivotally to said seat body at said open front end, and a second pivot end portion connected pivotally to said housing; and a damping unit extending in the longitudinal direction and including a fluid cylinder disposed in said receiving space and having one end that extends into said insert hole in said threaded support, and a piston rod extending through the other end of said fluid cylinder, said piston rod having an actuating end mounted on said first pivot end portion of said positioning member.

* * * * *